US005971238A

United States Patent [19]

Malvasi et al.

[11] Patent Number: 5,971,238

[45] Date of Patent: Oct. 26, 1999

[54] RETRACTABLE BOTTLE RETAINING HOLDER

[76] Inventors: Giuseppe Malvasi; Marina Polacci, both of Via Montegabberi, #1, 55049 Viareggio (LU), Italy

[21] Appl. No.: 09/001,351

[22] Filed: Dec. 31, 1997

[51] Int. Cl.[6] ..... A45F 5/00

[52] U.S. Cl. ..... 224/148.6; 224/162; 224/250; 224/269; 224/926; 242/404; 242/588.1

[58] Field of Search ..... 224/148.1, 148.4, 224/148.5, 148.6, 162, 191, 250, 269, 400, 412, 414, 463, 572, 926; 248/102, 103, 104; 222/175; 242/404.1, 404, 405, 588.1

[56] References Cited

U.S. PATENT DOCUMENTS

| | | | |
|---|---|---|---|
| 1,301,886 | 4/1919 | Tocknell | 248/102 |
| 1,750,672 | 3/1930 | Krischer | 248/102 X |
| 3,332,563 | 7/1967 | Reshan | 248/102 X |
| 3,369,723 | 2/1968 | Saari et al. | 224/148.6 |
| 4,090,650 | 5/1978 | Gotta . | |
| 4,095,812 | 6/1978 | Rowe | 280/289 |
| 4,139,130 | 2/1979 | Glusker et al. . | |
| 4,274,566 | 6/1981 | Rowe . | |
| 4,884,730 | 12/1989 | Carpenter | 224/162 |
| 4,902,261 | 2/1990 | Pratt et al. | 242/404.1 X |
| 5,016,845 | 5/1991 | Pellegrino | 248/104 |
| 5,238,160 | 8/1993 | Faulds . | |
| 5,265,769 | 11/1993 | Wilson | 222/175 |
| 5,301,858 | 4/1994 | Hollander . | |
| 5,390,836 | 2/1995 | Faulds . | |

FOREIGN PATENT DOCUMENTS

| | | | |
|---|---|---|---|
| 2233238 | 1/1991 | United Kingdom | 248/104 |

*Primary Examiner*—Gregory M. Vidovich
*Attorney, Agent, or Firm*—Cislo & Thomas LLP

[57] ABSTRACT

A retractable drinking bottle includes a reel, and a cord which ties a bottle to the reel. In the retracted position the bottle is placed side-by-side to the reel housing, and when the user desires to take a drink the bottle is grasped and pulled away from the reel. Thereafter, the bottle is retractable back to the reel. The reel preferably includes a housing that contains a retraction mechanism and a spool upon which a flexible line is wound. The preferred housing also includes a clip for attaching the reel to the user's clothing or to a vehicle such as a bicycle. An elastic cord is releasable attached to the end of the reel line, and the cord is formed into a loop. The bottle includes indentations sized to be received inside the loop of the cord. The bottle is also formed such that in the retracted position it nests inside the reel housing. The bottle is retractable to the holder after taking a drink, and the bottle is retained by the holder and cannot be dropped. The holder secures the bottle such that it will not vibrate or move about, and a drink is procured while exerting little force on the bottle. An alternate embodiment consists of a retractable reel and an adapter that retains an elastic cord that holds a conventional, cylindrical drinking bottle.

12 Claims, 3 Drawing Sheets

RETRACTABLE BOTTLE RETAINING HOLDER

BACKGROUND OF THE INVENTION

1. Field of the Invention

The present invention relates generally to a receptacle and cooperative holder for carrying liquids during periods of exercise. More particularly, the present invention relates to a retractable drinking bottle attached to a user directly or to a vehicle such as a bicycle.

2. Discussion of the Prior Art

Walking or running, bicycling and other similar activities are all popular forms of exercise. During such sustained physical activities the participant often desires a refreshing beverage such as water. Having a water bottle conveniently available ensures the participant's vital body fluids are replenished, without the need to interrupt the physical activity.

Cage bottle holders are well known for bicycles. These simple wire cage-like holders for conventional plastic cylindrical bottles are typically mounted to the bicycle frame below the level of the user's seat. When the cyclist becomes thirsty, he or she grasps the bottle from the holder, takes a drink, and then must replace the bottle inside the cage.

Although such cage holders have proven generally suitable for their intended purposes, they possess inherent deficiencies which detract from their overall effectiveness and desirability. During the time when the cyclist is physically manipulating the bottle, especially when he or she is replacing the bottle in the cage, the cyclist is distracted and may be off balance. This occurs because the cyclist must briefly look at the cage holder and lean towards it to reinsert the bottle inside. As a result, accidents can and do happen when the cyclist fails to see an approaching hazard ahead or falls off the bicycle. Other types of bottle mounts similarly require positioning and alignment of the bottle prior to reattaching it to the mounting portion of the device.

Worse yet than the rider being momentarily distracted or off balance, the rider could loose control of the bottle and drop it, in which case it would need to be retrieved or would be lost. Either stopping to get the bottle or leaving it in the road could pose a safety hazard for that rider, and other riders in the vicinity.

Another problem with cage bottle holders is invariably the cage is too tight or too loose. When the cage is too loose the bottle may vibrate and fall out of the holder, e.g. if the rider hits a big bump in the road. If the cage is too tight, it requires greater force to remove the bottle from the holder and reinsert the bottle back into the holder, which could cause the rider to loose his or her balance and fall. Additionally, scraping or rubbing the bottle against the cage usually damages the ornamental colors painted on the exterior of the bottle.

Although the prior art has recognized to a limited extent the shortcomings of such cage-like holders and other bottle holders, the proposed solutions have, to date, been ineffective in providing a satisfactory remedy. For example, drinking apparatus have been proposed for bicyclists and runners which include an elongate straw running from a restrained bottle. The elongate straw may be rigid and fixed such that one end resides in the bottle and the opposing end extends towards the user's mouth where it is convenient to sip a drink. Alternatively, the elongate straw may be flexible such that it is pushed back into the bottle after use, or retractably wound or self wound using memory flex tubing.

One problem with such devices having elongate straws is that considerable suction is required to drink from the bottle. This may prove exhausting for an athlete who is already tired by exercise. Additionally, the long straw is open on one end meaning the contents of the bottle are subject to contamination. Solutions have been proposed including placing one-way valves in a mouthpiece at the end of the tube extending to the user's mouth, but these systems are complex and expensive.

OBJECTS OF THE INVENTION

In view of the shortcomings of the prior art as outlined above, it is an object of the present invention to provide a bottle that is retractable to a holder, such that it is unnecessary to position and align the bottle to replace it in the holder after taking a drink.

Another object of the present invention is to provide a bottle that is retractable such that the bottle is always retained by the user and never dropped or lost.

Another object of the present invention is to provide a bottle holder that will securely retain the bottle, yet allow the user to easily procure a drink with little force being exerted to move the bottle.

Another object of the present invention is to provide a retractable bottle that is held securely such that it will not vibrate or move about.

Still another object of an alternate embodiment of the present invention is to provide an adapter attachable to a retractable reel, the adapter configured to hold a conventional cylindrical sports bottle.

Further objects of the present invention will become apparent from consideration of the drawings and ensuing description of selected embodiments of the invention.

SUMMARY OF THE INVENTION

The present invention specifically addresses and alleviates the above-mentioned deficiencies associated with the prior art. More particularly, the present invention is a retractable drinking bottle including a reel, and a cord which ties a bottle to the reel. In the retracted position the bottle is placed side-by-side to the reel housing. The bottle may be grasped and pulled away from the reel when the user desires to take a drink. Thereafter, the bottle is retractable back to the reel.

The reel includes a housing that contains a spool upon which a flexible line is wound. Preferably inside the spool is an automatic retraction mechanism, to reel in the line when it is unwound. The housing also preferably includes a belt clip or other mounting clip to attach the reel to the user's clothing or to a vehicle such as a bicycle. A cord is releasable attached to the end of the line, preferably by a small spring clip. The cord is preferably elastic, and formed into the shape of a loop.

The bottle includes indentations sized to be received inside the loop of the cord. Moreover, preferably there are a multiplicity of such indentations such that the bottle is easily grippable by the user. The bottle is also preferably formed such that in the retracted position it nests inside the reel housing. That is, multiple surfaces of the bottle are in contact with the reel housing, such that the bottle is securely held and will not move around.

The present invention also encompasses an alternate embodiment consisting of a retractable reel, and an adapter that retains an elastic cord that holds a conventional cylindrical drinking bottle. The adapter preferably consists of a casing which opens to accept the middle portion of the elastic cord, and closes to create a pair of loops which can be utilized to hold the bottle.

The present invention provides a bottle that is retractable to a holder, such that it is unnecessary to position and align the bottle to replace it in the holder after taking a drink. The bottle is always retained by the holder and cannot be dropped or lost. The bottle holder secures the bottle such that it will not vibrate or move about, and allows the user to easily procure a drink while exerting little force to move the bottle. The alternate embodiment provides an adapter attachable to the retractable reel, the adapter configured to hold a conventional cylindrical sports bottle. The invention is simple and inexpensive.

These, as well as other advantages of the present invention will become apparent from the following description and drawings. It is understood that changes in the specific structure shown and described may be made within the scope of the claims which follow without departing from the spirit of the invention.

DETAILED DESCRIPTION OF THE PREFERRED EMBODIMENT

Figure 1:
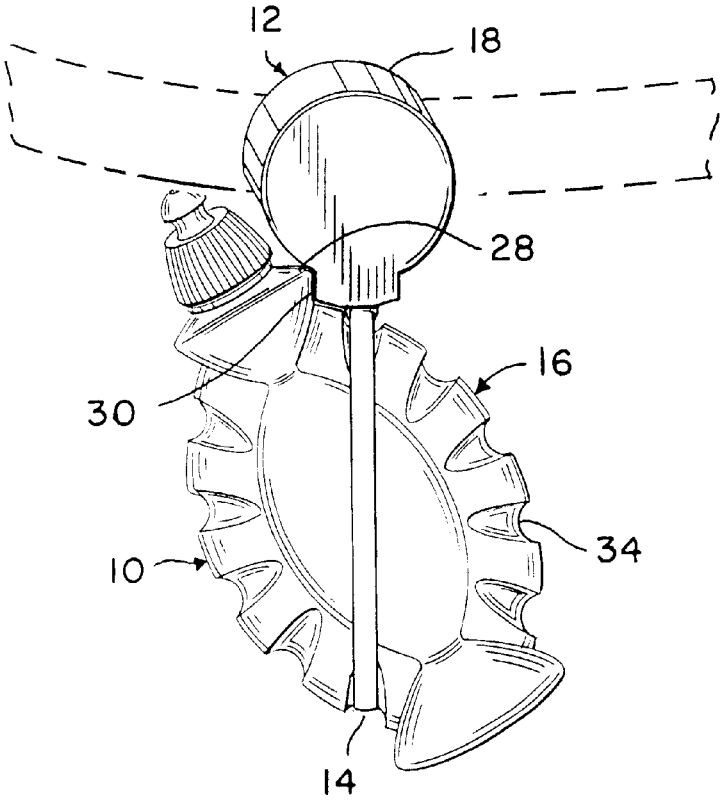
FIG. 1 is a perspective view of the retractable drinking bottle in accordance with the present invention, the bottle shown in the retraced position and the reel attached to a user's belt.
Figure 2:
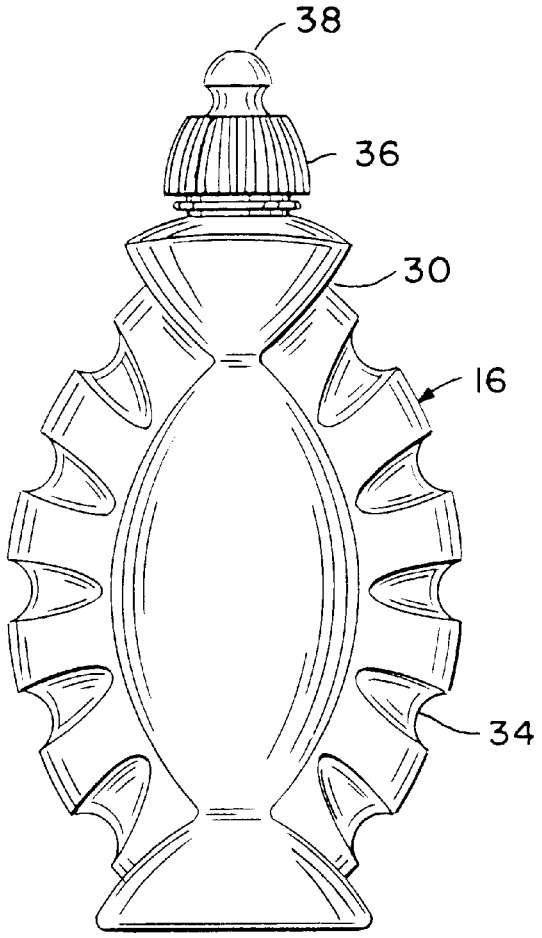
FIG. 2 is a front view of the bottle in accordance with the present invention.
Figure 3:
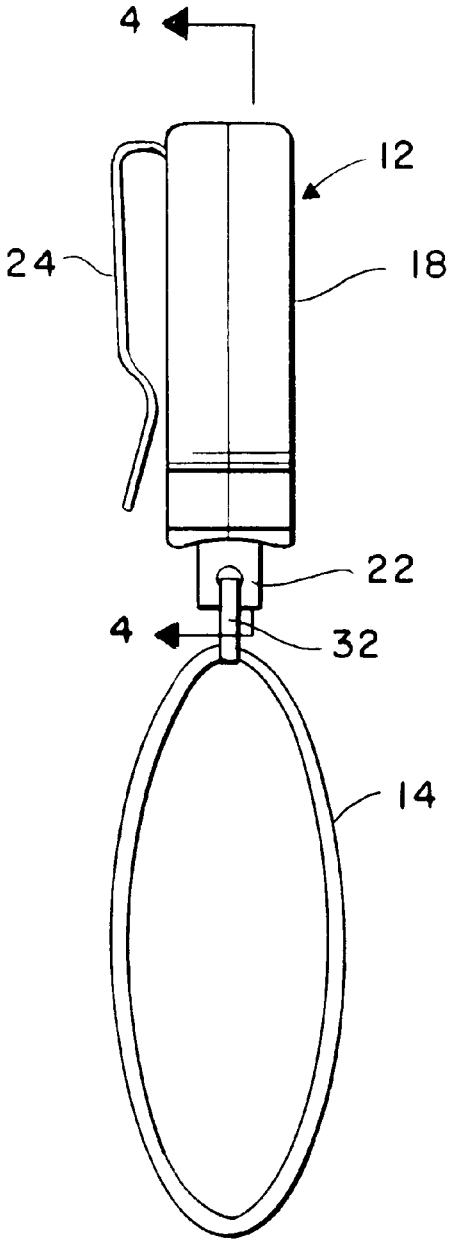
FIG. 3 is a side view of the reel and an elastic loop that holds the bottle.
Figure 4:
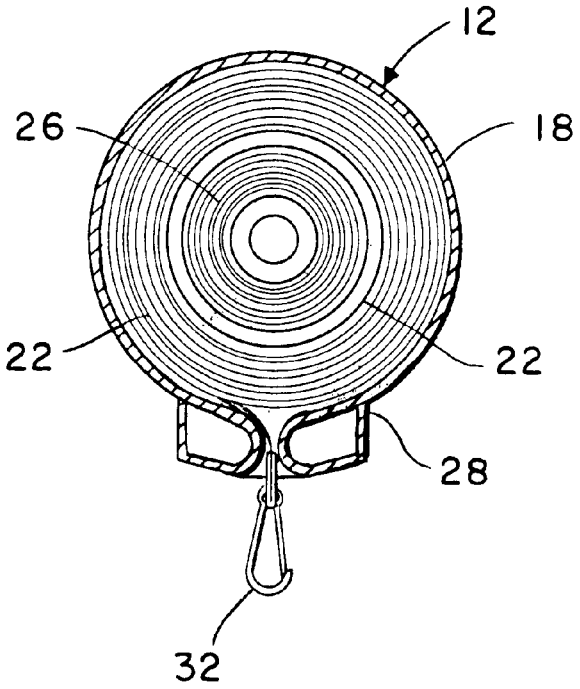
FIG. 4 is a section view inside the reel housing.

The detailed description set forth below in connection with the appended drawings is intended as a description of the presently preferred embodiments of the invention, and is not intended to represent the only forms in which the present invention may be constructed or utilized. The description sets forth the functions and the sequence of steps for constructing and utilizing the invention in accordance with the illustrated embodiments. It is to be understood, however, that the same are equivalent functions and sequences may be accomplished by different embodiments that are also intended to be encompassed within the spirit and scope of the invention.

The retractable bottle retaining holder of the present invention is illustrated in FIGS. 1–7 which depict presently preferred embodiments of the invention.

Referring first to FIGS. 1–5, a retractable drinking bottle 10 generally includes a reel 12, an elastic cord in the shape of a loop 14, and a grippable sports bottle 16. The bottle 16 may be fully retracted to lie side-by-side with the reel 12, or it may be extended away from the reel 12 to facilitate taking a drink from the bottle 16. The bottle 16 is shown in the retracted position in FIG. 1, and the loop 14 is shown slightly extended from the reel 12 in FIG. 3. The bottle 16 can be pulled approximate ly four feet away from the reel 12.

The reel 12 preferably includes a housing 18, which contains a spool 20 upon which flexible line 22 is wound. Attached to the outside of the housing 18 is a clip 24, for mounting the reel 12 to the user's belt and shown in FIG. 1, or for mounting the reel 12 to a vehicle such as a bicycle (not shown). Inside the spool 20 is a conventional automatic retraction mechanism 26 such as a spring, which operates to automatically rewind the flexible line 22 upon it being extended outside the reel housing 18.

The bottle 16 and reel housing 18 are configured to be in contact with each other when the bottle 16 is in the retracted position. Specifically, the reel housing 18 includes a recess 28, which corresponds to a recess 30 in the bottle 16, such that multiple surfaces of the reel housing 18 and bottle 16 are nested together when the bottle 16 is in the retracted position. This serves to securely hold the bottle 16 against the reel 12, such that the bottle 16 is not freely flopping around. The loop 14 of elastic cord is preferably releasably attached to the free end of the flexible line 22 by a conventional spring clip 32, of a size small enough not to interfere with the nesting of the bottle 16 to the reel 12 described above. The spring clip 32 must also be of a large enough size so as not to be wound inside the opening of the reel housing 18.

The drinking bottle 16 includes a multiplicity of indentations 34 about portions of its outside surface. The indentations 34 are sized to receive the loop 14 of elastic cord. The indentations 34 also serve another purpose, that being to make the bottle easily grippable by the fingers of the user in grasping the bottle.

Figure 5:
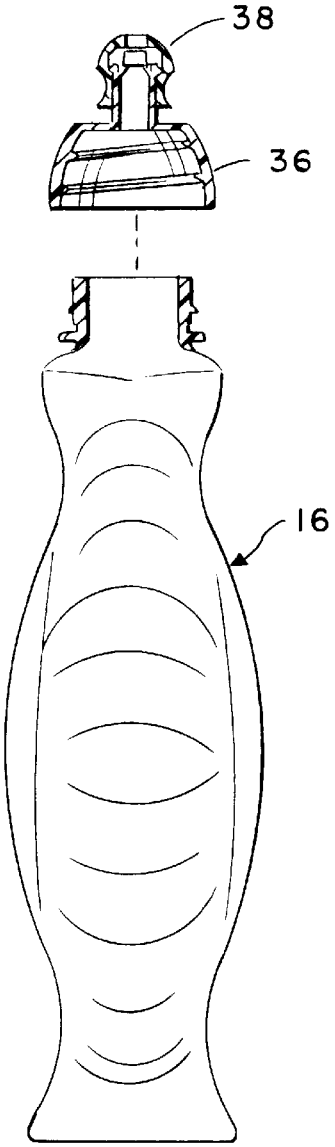
FIG. 5 is a side view of the bottle, with the cap (shown in cross-section) removed and the spout (shown in cross-section) in the open position.

As shown in FIG. 5, the cap 36 of the bottle 16 is removable for filling the bottle 16 with liquid such as water. Also, the spout 38 of the cap 36 is extendable (as shown in FIG. 5) to allow liquid to flow through the cap 36 and to the user, upon turning the bottle 16 over or squeezing the bottle 16.

Figure 6:
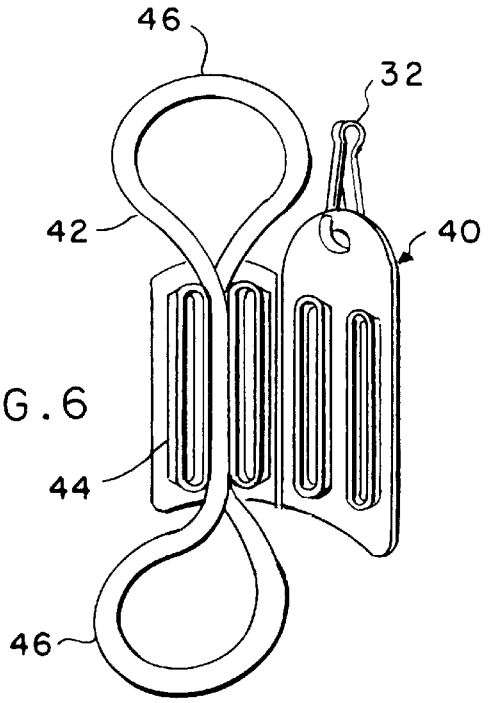
FIG. 6 is a perspective of the adapter in accordance with the alternate embodiment of the present invention, the adapter shown in the open position.
Figure 7:
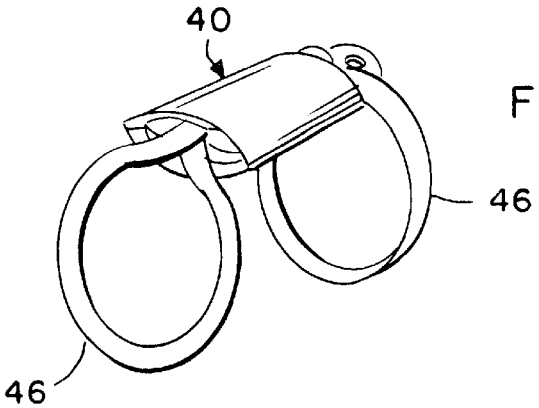
FIG. 7 is a perspective view of the adapter shown in the closed position.

Now we turn to FIGS. 6 and 7, an alternate embodiment is shown which includes an adapter 40 attached to a reel 12. The adaptor 40 also holds a conventional, cylindrical sports bottle (not shown). The adapter 40 is shown in the open position in FIG. 6. A loop 42 of elastic cord is placed between a pair of upstanding walls 44, such that a pair of smaller loops 46 are formed. Then the adapter 40 is closed shut, and the pair of loops 46 may be stretched around opposing ends of the sports bottle. A conventional spring clip 32 is again used to make the attachment to the free end of the flexible line 22 of the reel 12.

Now having described the structure of the preferred embodiments of the present invention, it is possible to describe the operation, function and use of the same. The reel 12 is first attached via the clip 24 to the user's belt, or the reel 12 is mounted to the frame of a bike (not shown). The flexible line 22 is retracted inside the reel housing 18, and only a portion of the spring clip 32 protrudes outside the housing 18.

The cap 36 of the bottle 16 is removed, and the bottle 16 is filled with liquid such as water or some other refreshing beverage. The cap 36 is replaced and the loop 14 of elastic cord is placed around the bottle 16. To attach the bottle 16 to the reel 12, the user grasps the spring clip 32 and pulls it a short distance away from the reel housing 18. Then the user opens the spring clip 32, and places a portion of the elastic cord 14 therein. Then the user releases the bottle 16, which is retracted towards the reel housing 18 as the flexible line 22 is automatically rewound inside the reel housing 18. The bottle 16 comes into contact and nests against the reel housing 18, at the corresponding recesses 28, 30 of the reel housing 18 and the bottle 16, respectively. The bottle 16 is securely retained against the reel 12.

When the user decides to drink from the bottle 16, the user grasps it with his or her fingers lying in the indentations 34 in the bottle 16. The user pulls the bottle 16 towards his or her mouth, which causes the flexible line 22 to unwind and extend away from the reel housing 18. The user is free to invert the bottle 16 and dispense water through the open spout 38.

Thereafter, the user closes the spout 38, and simply releases the bottle 16 guiding it in the general direction of the reel 12. The user need not look at the reel 12 to precisely position the bottle 16 for attachment thereto, or need not worry about losing control of the bottle 16 or dropping it to the ground.

The alternate embodiment of FIGS. 6 and 7 is similarly useful for adapting the retractable reel 12 to a conventional sports bottle (not shown). The adapter 40 is open about its hinged connection on one side, and the elastic cord 42 is inserted between the pair of upstanding balls 44. Then the adapter 40 is closed which creates the pair of smaller loops 42 for holding the sports bottle. Both of the smaller loops 46 are stretched around opposing ends of the bottle. Then the adapter 40 is attached to the spring clip 32 of the reel 12. The conventional bottle may be pulled towards the user to get a drink, and then is automatically retracted to the reel 12.

It is understood that the embodiments described herein and shown in the drawings represent only presently preferred embodiments of the invention. Indeed, various modifications and additions may be made to such embodiments without departing from the spirit and scope of the invention. These and other modifications and additions may be obvious to those skilled in the art and may be implemented to adapt the present invention for use in a variety of different applications.

What is claimed is:

1. A retractable drinking bottle comprising:

a reel having a housing containing a spool upon which a flexible line is wound;

a cord attached to the line, the cord formed in the shape of a loop;

a bottle having indentations sized to receive the loop of the cord;

whereby the flexible line is selectively wound tight about the spool to move the bottle to a retracted position juxtaposed the reel housing and unwound to move the bottle away from the reel, the reel housing further comprising a clip attached thereto for releasably attaching the reel housing to a fixed location.

2. The retractable drinking bottle of claim 1 wherein the bottle and reel housing are configured to be in contact in the retracted position.

3. The retractable drinking bottle of claim 2 wherein the bottle and reel housing are configured such that multiple surfaces of each are in contact in the retracted position.

4. The retractable drinking bottle of claim 3 wherein the reel housing is formed to nest with the bottle in the retracted position.

5. The retractable drinking bottle of claim 1 wherein the fixed location is clothing of a user.

6. The retractable drinking bottle of claim 1 wherein the fixed location is a vehicle.

7. The retractable drinking bottle of claim 1 wherein the cord is elastic.

8. The retractable drinking bottle of claim 1 wherein the cord is releasably attached to the flexible line.

9. The retractable drinking bottle of claim 8 further comprising a cord clip to releasably attach the cord to the flexible line, the cord clip sized so as not to interfere with the bottle contacting the reel housing in the retracted position.

10. The retractable drinking bottle of claim 1 wherein the reel housing includes an automatic retraction mechanism to rewind the flexible line after being unwound.

11. The retractable drinking bottle of claim 1 wherein the bottle includes a multiplicity of indentations sized to receive a user's fingers in grasping the bottle.

12. A retractable drinking bottle comprising:

a reel having a housing containing a spool upon which a flexible line is wound;

a cord releasably attached to the line by a cord clip, the cord formed in the shape of a loop;

a bottle having indentations sized to receive the loop of the cord;

whereby the flexible line is selectively wound tight about the spool to move the bottle to a retracted position juxtaposed the reel housing and unwound to move the bottle away from the reel, the reel housing further comprising a clip attached thereto releasably attaching the reel housing to a fixed location.

* * * * *